US005193458A

United States Patent [19]

Keller

[11] Patent Number: 5,193,458

[45] Date of Patent: Mar. 16, 1993

[54] GRIPPER BAR CONVEYOR FOR MULTIPLE COLOR OFFSET ROTARY PRINTING PRESS

[76] Inventor: James J. Keller, 4023 Glenridge Rd., Dallas, Tex. 75220

[21] Appl. No.: 902,875

[22] Filed: Jun. 23, 1992

[51] Int. Cl.[5] ..... B41F 31/06

[52] U.S. Cl. ..... 101/137; 101/157; 101/408

[58] Field of Search ..... 101/407.1, 408, 157, 101/136-137, 142, 145, 152, 154, 174, 177, 183, 184, 217, 218, 246, 247, 248; 271/277

[56] References Cited

U.S. PATENT DOCUMENTS

| | | | |
|---|---|---|---|
| 1,514,049 | 11/1924 | Ichida | 101/137 |
| 2,231,914 | 2/1941 | Huck | 101/184 |
| 3,283,710 | 11/1966 | Zahradwik et al. | 101/408 |
| 3,664,261 | 5/1972 | Dahlgren | 101/184 |
| 3,814,014 | 6/1974 | Dahlgren | 101/408 |
| 5,085,143 | 2/1992 | Becker | 101/183 |
| 5,125,334 | 6/1992 | Marx et al. | 101/408 |

*Primary Examiner*—Eugene H. Eickholt
*Attorney, Agent, or Firm*—Ross, Howison, Clapp & Korn

[57] ABSTRACT

A gripper bar conveyor mechanism for transferring sheets to be printed from one rotating impression cylinder to another in a multiple color rotary offset printer of the type having sets of impression cylinders and corresponding blanket cylinders for rolling contact with the sheets to be printed therebetween. The gripper bar conveyor mechanism includes a transferrable gripper bar activatable for releasably securing sheets to be printed in a fixed orientation with respect to the transferrable gripper bar. The registration projection is affixed to the transferrable gripper bar. A registration pocket is adjustably affixed to each of the impression cylinders for temporarily receiving the registration projection of the gripper bar and thereby holding the gripper bar in a desired position with respect to the impression cylinder. A conveyor band is attached to the gripper bar and is operably connected to the rotary offset press for moving the gripper bar from one impression cylinder to the next. The registration projection is engaged in the registration pocket at each of the impression cylinders during a portion of the impression cylinder rotation which is sufficient to initialize rolling contact of the sheet to be printed in proper registration between the impression cylinder and the corresponding blanket cylinder at each set of impression and blanket cylinders.

18 Claims, 5 Drawing Sheets

GRIPPER BAR CONVEYOR FOR MULTIPLE COLOR OFFSET ROTARY PRINTING PRESS

TECHNICAL FIELD OF THE INVENTION

The present invention relates to the paper feed mechanism for a multiple color rotary offset printing press, and in particular, to a gripper bar conveyor mechanism for paper transfer and registration from one impression cylinder to another.

BACKGROUND OF THE INVENTION

Rotary offset printing machines have been used for a number of years. The basic mechanisms, principles, and steps of operation for modern rotary printers include chemically forming an image on a thin metal image plate. The thin image plate therearound is attached around the circumference of a plate cylinder. Ink and a water solution are applied by rollers to the respective chemically treated areas that are to form an image on the image plate as it rotates with the plate cylinder. The plate cylinder rolls the image plate against a blanket cylinder offsetting a reverse image around the circumference of the blanket cylinder. A sheet of print paper or other material to be printed is fed into the press and gripped by an impression cylinder. The impression cylinder pulls the paper into rolling contact between the blanket cylinder and the impression cylinder. Under rolling pressure between the two cylinders, the image is imprinted from the blanket cylinder onto the paper. The imprinted image is the reverse of that on the blanket cylinder so that it is appears as originally formed on the image plate. After the paper is imprinted, it is removed from the impression cylinder gripper and transferred either to a collection tray if printing is finished, or to another impression cylinder, if additional colors or images are to be applied. The subsequent impression cylinder grips the print paper from a transfer gripper and rolls the paper against a subsequent blanket cylinder for additional printing.

In multi-color offset printers, each color is applied as a series of minute dots or patterns. It is extremely important to precisely locate or register the paper as it is gripped by each of the impression cylinders, so that each subsequent matrix of colored dots can be properly located and coordinated with respect to other color dots to form the desired image. Quality printing requires precise location of the dots within thousandths of an inch of each other. An error in alignment of a few thousandths of an inch can produce a blurred image or an image with improperly mixed and overlapping color dots.

In the past, multiple color offset rotary printers accomplished this precise registration through careful attention to the transfer of the paper using precisely manufactured fixed diameter transfer cylinders. Usually, the transfer cylinders are large enough to carry two sheets of print paper spaced end-to-end around the circumference of the cylinder. The rotation of the transfer cylinders had to be carefully timed with respect to the rotation of the impression cylinders so that the paper when picked up by the transfer cylinders from one of the impression cylinders was carried around the transfer cylinder at precisely the correct speed and distance so that it was gripped by a subsequent impression cylinder precisely in the correct location for registration. The grippers for each impression cylinder had to be adjusted until the dots were printed precisely at the desired location.

The use of transfer cylinders has been important because of the extreme criticality of precise registration. The cylinders, once formed, have a fixed diameter and can be rotated through gears at a fixed speed. Repeatable transfers are thus made possible. However, this structure is complex and expensive. Further, it introduces associate problems. For example, smearing can result because the printed surface of the paper being transferred is directed inward on each transfer cylinder. Thus, the printed surface of the sheet faces outward toward the blanket cylinder when it is gripped by the next impression cylinder. Special coatings, special non-stick screens, and even complex systems for air cushioning the paper as it is carried around the transfer cylinder have been employed in order to minimize this smearing problem.

The cost of manufacturing multiple color offset printers has been very high because of the complexity of multiple transfer gripping mechanisms, large precision-built transfer cylinders, and non-smear mechanisms. Further, because of the need to properly adjust registration of the paper as it is received by each impression cylinder, transferred to each transfer cylinder and then received by each subsequent impression cylinder, the time and expense to set up any given multiple color offset printing job has been substantial. It is not uncommon for an operator to spend a considerable amount of time setting up a job and to use over five hundred (500) trial printing sheets before proper registration is obtained for all of the color impression cylinders. As a result, multiple color offset rotary printing has not been economically feasible for most small printing jobs requiring less than several thousand copies.

SUMMARY OF THE INVENTION

It is an object of the present invention to provide a multiple color rotary printing press with an inexpensive mechanism for transferring printing sheets therethrough with accurate registration alignment at each impression cylinder. A transferable gripping bar is provided for gripping sheets to be printed. The transferable gripping bar is provided with a registration projection. A corresponding projection receiving pocket is formed in each impression cylinder for accurately receiving the registration projection and holding the transferable gripping bar in alignment. A conveyor band is attached to the gripper bar for moving the gripper bar from one impression cylinder to the next. Thus, a sheet of paper is gripped once by the gripper bar and is conveyed by the same gripper bar to each impression cylinder in the multiple color rotary offset printing press.

Another feature of the invention is the use of a registration projection which is a wheel having a V-shaped peripheral surface and a corresponding semi-circular shaped projection receiving pocket having a V-shaped rail corresponding to the peripheral shape of the wheel. The pocket rotates with each impression cylinder and the conveyor band carries the gripper bar to each impression cylinder so that the wheel rolls and slides into the pocket in precise registration alignment, both radially and axially with respect to the impression cylinder.

Another feature of the invention employs a registration projection on two spaced apart ends of the gripper bar with corresponding registration pockets at each axial end of the impression cylinder. A pair of parallel conveyor bands are attached at each end of the gripper bar to carry it suspended therebetween, as it is conveyed from one impression cylinder to the next. The gripper bar is attached to the conveyor band with a flexible bracket so that minor misalignment of the conveyor band with respect to precise registration is accommodated when the registration projection engages into the registration pocket. In this manner, inexpensive conveyor bands such as roller chains on sprockets or indexable belts on pulley gears can be employed as the conveyor band, even though minor deviations in the indexing of the band with respect to the rotation of the impression cylinders may result from wear or stretching and the like.

BRIEF DESCRIPTION OF THE DRAWINGS

The foregoing objects, advantages, and features, as well as other objects and advantages will become more apparent with reference to the description and drawings below, in which like elements represent like numerals and in which.

DETAILED DESCRIPTION OF THE PREFERRED EMBODIMENTS

Figure 1:
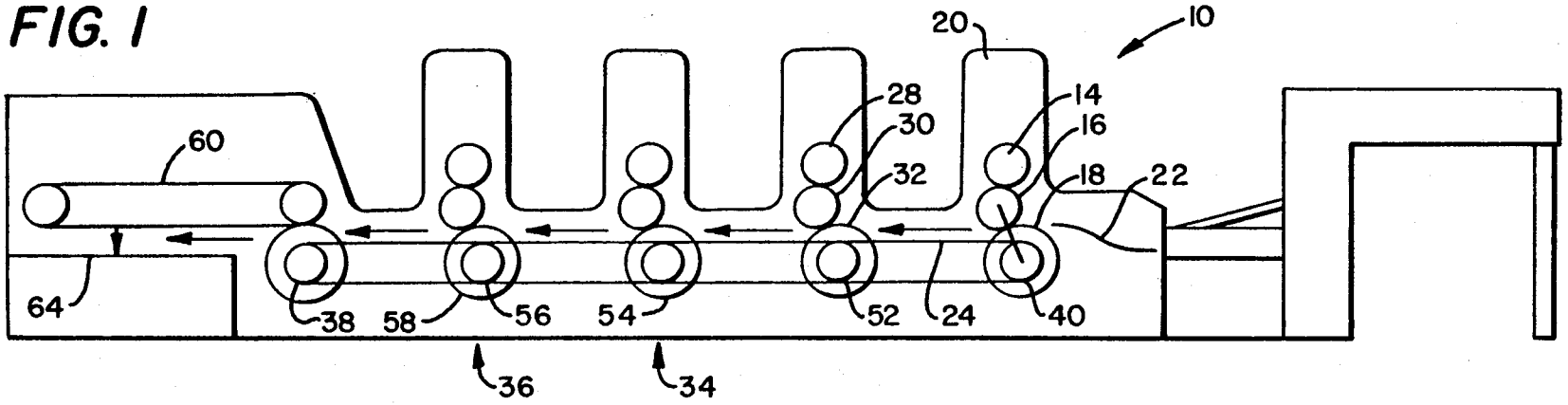
FIG. 1 is a schematic side view of a multiple color rotary printing press according to the present invention.

FIG. 1 shows a schematic side view of a multiple color offset rotary printing press 10. The press includes a first set 12 of color cylinders and rollers, including a first plate cylinder 14, a first blanket cylinder 16, and a first impression cylinder 18. Inking rollers and dampening rollers (not shown) are held and configured in area 20 in a manner known by those skilled in the art for applying ink and a dampening water solution to a printing plate carried around plate cylinder 14 in a conventional manner. The image from plate cylinder 14 is applied in reverse to blanket cylinder 16. A sheet of paper 22 is fed between blanket cylinder 16 and impression cylinder 18 as will be described more fully below, to imprint the image from the blanket cylinder onto the sheet 22 to be printed, which is conveyed on conveyor band 24 from the first set 12 to the second set 26 of color image applying cylinders of a conveyor band 24. A second plate cylinder 28 receives ink and dampening solution and transfers its image to second blanket cylinder 30 which in turn imprints the second color image on the sheet as it is rolled between blanket cylinder 30 and second impression cylinder 32. The sheet is carried along conveyor band 24 to each subsequent set of color cylinders and rollers 34 and last set 36. Each set operates substantially similar to the first and second sets to print an image or a portion of the image, such as one color formed of a matrix of dots or small patterns. After each matrix of dots and patterns are imprinted on sheet 22, it is transferred by conveyor band 24 to a skeleton cylinder 38 where it is released from the conveyor band 24 and carried by a delivery chain 60 to deliver the printed sheet to a collection tray.

Figure 2:
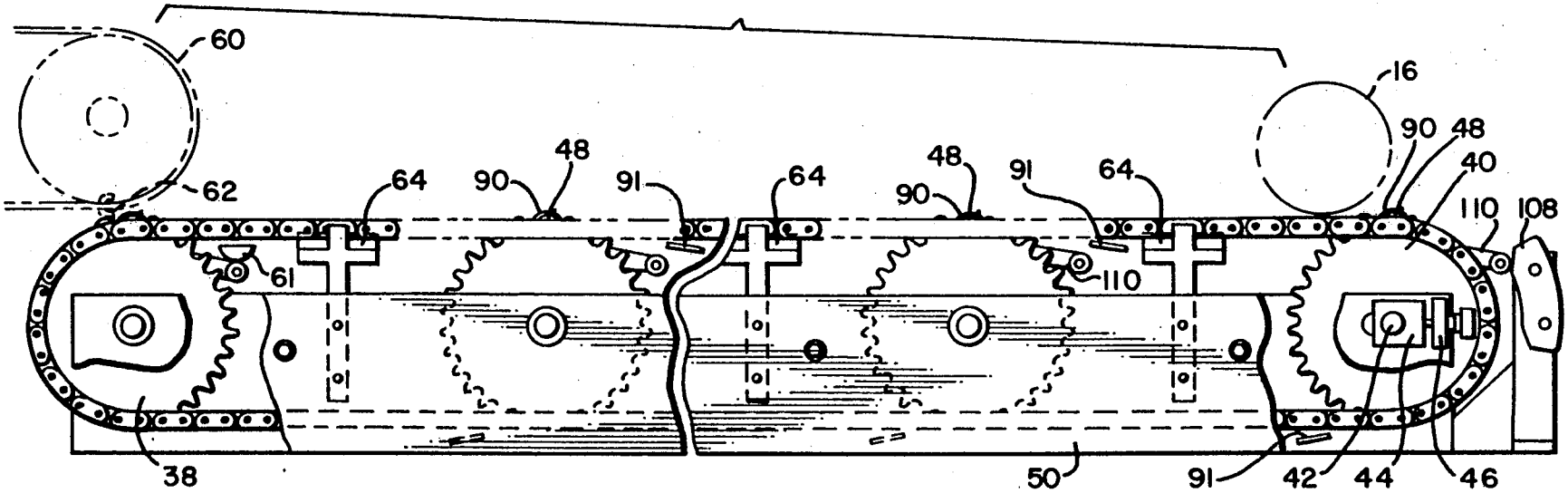
FIG. 2 is a side plan view with partial cut-away portions showing an embodiment of a gripper bar conveyor band.

With reference to FIG. 2 which depicts a partially cut-away side view of the gripper bar conveyor mechanism for a multiple color offset rotary printing press, the structure and operation of the gripper bar 48 and conveyor band 24 in cooperation with the impression cylinders will be more fully understood. It will be noted that for purposes of clarity, the plate cylinders, the blanket cylinders, and the inking and dampening rollers are not depicted at each set of cylinders and rollers. However, the location only of blanket cylinder 16 is shown in FIG. 2 with phantom lines. Other cylinders and rollers will be correspondingly located as schematically set forth in FIG. 1. Conveyor band 24 is carried adjacent the periphery of first impression cylinder 18 by first drive wheel 40. Both the first drive wheel 40 and the first impression cylinder 18 are coaxially rotated on axle 42 which is supported for rotation by bearing block 44. Standard locking mechanisms (not shown) such as keys or set screws may be used to insure that the impression cylinders and conveyor drive wheels rotate together on the axle 42. Bearing block 44 may be adjustably secured to press frame 50 through adjustment mechanism 46 for appropriate adjustment of the spacing between the impression cylinders and for adjustment and appropriate tensioning of the conveyor band 24.

Conveyor band 24 is operatively connected attached to a gripper bar 48 so that the gripper bar is moved by the conveyor band from the first impression cylinder 18 to the second impression cylinder 32 and to subsequent impression cylinders 54 and 58. Uniquely, according to the present invention, the sheet is continuously held by gripper bar 48 so that the sheet is not released and regripped at each impression cylinder. Rather, the gripper bar is moved from impression cylinder to impression cylinder. The conveyor band is supported with drive wheel 40 at impression cylinder 18, drive wheel 52 at impression cylinder 32, and a drive wheel at each subsequent impression cylinder until the last impression cylinder 58 has a corresponding drive wheel 56. The conveyor band 24 continues around a drive wheel 38 which forms the skeleton cylinder 38, so named because there is no impression cylinder, but rather only the wheel 38 for returning the continuous conveyor band 24. As the gripper bar 48 is attached to the conveyor band 24, it moves around skeleton cylinder 38 past the bottom of each impression cylinder 56, 54, and 52 and is reengaged in proper registration with impression cylinder 18 for beginning the imprinting process again. The registration wheels 90*a* and 90*b* of gripper bar 48 register in registration pockets 88*a* and 88*b*, properly orienting gripper bar 48 with impression cylinder 18. A new sheet 22 is gripped by multiple gripper fingers and held securely as it is passed between impression cylinder 18 and blanket cylinder 16 for imprinting thereon. The registration of gripper bar 48 is repeated for all sets of printing cylinders. The sheet is only then released to the delivery gripper 62 on delivery chain 60 which travels in close proximity to skeleton cylinder 38. Thus, after imprinting at last impression cylinder 58, the gripper bar is carried and therefore carries the printed sheet to skeleton cylinder 38 where gripper bar 48 is cam-actuated to release the sheet 22. Simultaneously, cam actuation of a delivery gripper 62 grips the printed sheet and caries it via delivery chain 60 to deposit it at a collection tray 64.

Figure 3:
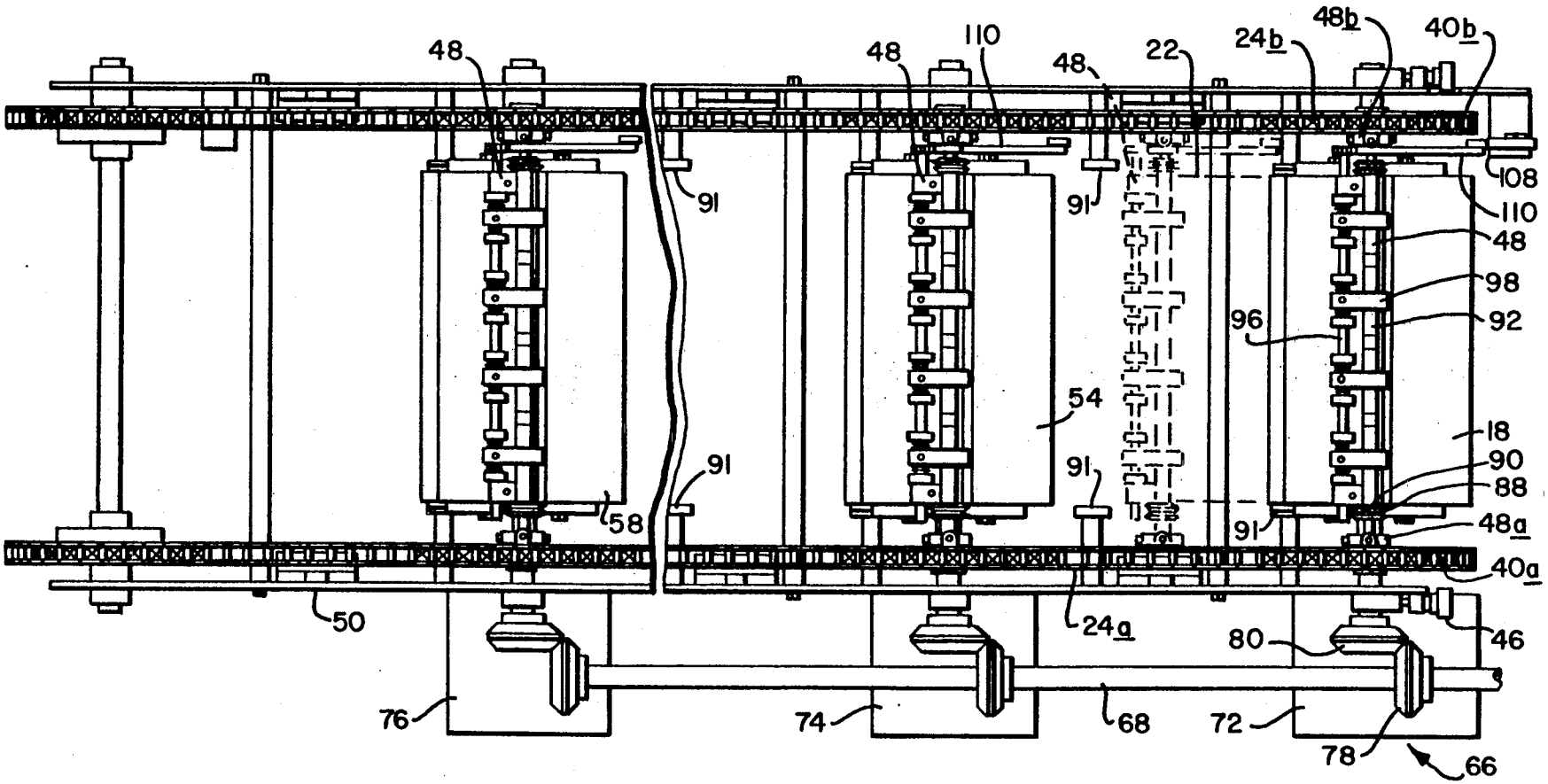
FIG. 3 is a top plan view showing multiple transferable gripper bars and conveyor band and parallel conveyor bands according to the present invention.

The conveyor band 24 is depicted in a preferred embodiment, as shown in FIGS. 2 and 3, as a roller link conveyor chain 24 and carrier wheel 40 is depicted as sprocket 40. Conveyor bands constructed of other materials, such as belts, cables, cords, etc. may also be employed, provided that they are configured with an appropriate indexing means, such as that provided by the roller links and sprockets for the conveyor chains depicted, or such as that provided by uniform teeth on a fan belt (such as a timing belt) with corresponding pulley gears as drive wheels. The band 24 is thus flexible to form a continuous conveyor loop, yet is indexed to move correspondingly with the rotation of the impression cylinders. Means for attaching the gripper bars to the chain, belt, cable, cord, or etc. must also be provided. Links with attachment tabs are typically available for roller link chain. For purposes of clear explanation of the preferred embodiment shown in the Figures and clarity, conveyor band 24 will sometimes be referred to as conveyor chain 24 and the drive wheels carrying the conveyor band chain 24 will correspondingly be referred to as sprockets 40, 52, 56, and 38 as the case may be, for carrying conveyor chain 24.

Each of the drive sprockets 40, 52, and 56 rotate with the corresponding impression cylinders 18, 32, and 58, respectively. The distance between each impression cylinder is preferably fixed during operation. Axle bearings for each respective impression cylinder location are mounted on frame 50. The distance between each impression cylinder preferably corresponds to the maximum size of the sheet to be printed, which size corresponds to the circumferential impression cylinder surface. Adjustment of this distance may be accomplished with an adjustment mechanism 46.

The impression surface of each impression cylinder is less than the circumference of a circle of the same diameter because an opening 86 (as will be explained below) is formed in each impression cylinder. The gripper bar 48 fits into opening 86 and is to be registered, as described herein.

Each impression cylinder is directly driven in synchronization with each other impression cylinder as through a power gear train 66 interconnected from each impression cylinder to the power supply (not shown). The conveyor band 24 may transmit power from one cylinder to the next, but is preferably not for transmitting rotational force to the impression cylinders. Rather, power is preferably provided from each impression cylinder to the conveyor band to move it in synchronization with each impression cylinder. This reduces the strain, wear, and stretching of the conveyor band or conveyor chain and therefore maintains closer synchronization with each impression cylinder as the conveyor band is driven thereby. As some wearing or stretching may nevertheless occur, the chain is preferably supported between each of the drive sprockets, as with multiple support rails 64, which are securely fastened to frame 50.

FIG. 3 schematically depicts the impression cylinders 18, 32, 54, and 56 in a top view with the corresponding blanket cylinders, plate cylinders, inking rollers, and dampening rollers removed. The power train 66 may be any conventional gear driven power train by which impression cylinders 18, 32, 54, and 58 are driven at the same rotational speed. A drive shaft 68 is rotated by a power source and advantageously drives each of the impression cylinders through a bevel gear power transmission unit at each impression cylinder. The number of bevel gear transmission units will correspond to the number of impression cylinders. In FIG. 3, bevel gear transmission units 72, 74, and 76 are depicted. An advantageously simple bevel gear transmission unit 72 comprises a drive bevel gear 78 coaxially affixed to shaft 68. Bevel gear 78 meshes with axle gear 80, which is coaxially affixed to impression cylinder 18. Preferably to reduce wear and to maintain accurate synchronization, helical bevel gears 78 and 80 are used.

Further in the preferred embodiment, as shown in FIG. 3, multiple gripper bars 48 will be carried by conveyor band 24, each spaced apart therealong at a distance corresponding to the distance between each impression cylinder. Each gripper bar 48 holds a separate sheet 22 to be printed. Thus, each set of impression cylinders and blanket cylinders applies its image to a sheet 22 as it is carried through the rotary printing process. An intermediate position for a gripper bar 48 is depicted in phantom lines between impression cylinder 18 and impression cylin ler 32 to show how the gripper bar moves from one set of printing cylinders to the next. A sheet 22 is securely held by each gripper bar 48 as it is conveyed from first impression cylinder 18 to second impression cylinder 32, from second impression cylinder 32 to third impression cylinder 34, and to each subsequent impression cylinder to the last impression cylinder 58.

As also shown in FIG. 3, conveyor band 24 preferably comprises a pair of conveyor bands 24*a* and 24*b* or conveyor chains 24*a* and 24*b*, which move continuously parallel and synchronized from one impression cylinder to the next. In this embodiment, gripper bar 48 is attached at spaced apart locations, such as at each of its ends 48*a* and 48*b* to chains 24*a* and 24*b*, respectively. Sprockets 40*a* and 40*b* are coaxially mounted at each end of each impression cylinder and are rotated coaxially therewith. The sprockets 40*a* and 40*b* carry and drive the conveyor chains and gripper bars from one cylinder to the next as described above.

Figure 4:
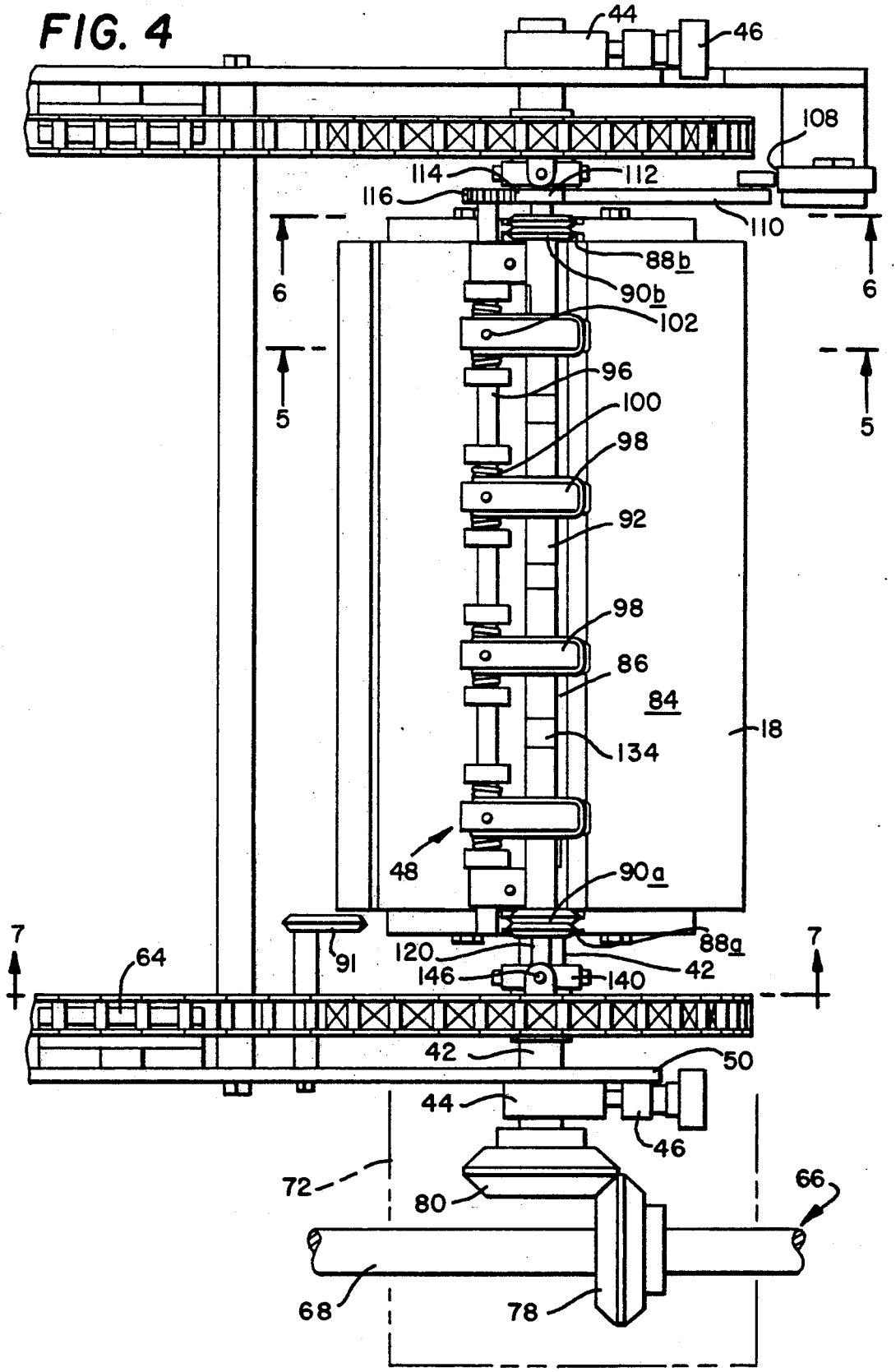
FIG. 4 is a partial top plan view detail of one of the impression cylinders and transferable gripper bars according to the present invention.

The details of construction and operation of the gripper bar and conveyor mechanism according to the present invention can be more fully understood with reference to FIG. 4, which is an enlarged partial cut-away top plan view of impression cylinder 18 and gripper bar 48. It will be understood that the construction is similar for each impression cylinder in a multiple cylinder rotary press. The impression cylinder 18 is preferably formed of a rigid metal casting having a hollow central portion 82 to reduce weight, and a ground cylindrical surface 84 against which printing impression occurs. The cylindrical surface 84 is interrupted by an opening 86 into the hollow central portion 82. Preferably, the opening 86 extends or interrupts the otherwise continuous cylindrical surface 84 for less than approximately one cylindrical quadrant of the entire cylindrical surface 84. A registration pocket 88 is formed adjacent the cylindrical opening 82 for receiving registration projection 90 attached to gripper bar 48. In the preferred embodiment, registration pocket 88 comprises two axially spaced apart registration pockets, 88*a* and 88*b* for receiving corresponding registration projections 90*a* and 90*b* attached spaced apart on the gripper bar, as will be explained more fully below. The use of two spaced apart pockets and projections advantageously provides stability and facilitates repeatable registration from one set of printing cylinders to the next.

Although a single registration pocket 88 with a single registration projection 90 could be advantageously used over previously known presses to allow a gripper bar to register from one cylinder to the next according to the present invention, it is preferable to have two pockets axially disposed on either end of the impression cylinder 18 and either end of gripper bar 48, respectively. Ease of alignment and adjustment for securely holding the gripper bar in proper registration while imprinting is initiated and is also facilitated by this preferred construction.

The gripper bar 48 is preferably constructed of a strong, rigid material, such as steel, which is appropriately hardened for strength and to resist wear and abrasion. The gripper bar may be constructed having a main beam 92 onto which an exterior flat surface 94 is formed. A gripper shaft 96 is attached to main beam 92 in a parallel orientation spaced ahead of main beam 92 in the direction of motion. Multiple individual gripper fingers 98 are pivotably attached to shaft 96 for pivoting into gripping engagement with the flat surface 94 of the main beam 92. In the preferred embodiment shown, each of the individual gripper fingers 98 are pivotably attached to shaft 96 and resiliently biased toward gripping engagement. Shaft 96 appropriately engages with each of the individual gripper fingers 98 at 102 so that partial rotation of the shaft 96 causes lifting of all of the individual gripper fingers 98 against clamping bias springs 100. In this manner, a space is opened between a horizontal gripper face 104 and flat surface 94. A vertical surface 106 is preferably formed on each gripper finger 98, uniformly spaced from the gripper shaft 96. A cam 108 operates an arm 110 to partially rotate shaft 96 to open the gripper fingers 98. An edge of a sheet 22 to be printed, such as a piece of printing paper, is fed into the gripper opening between flat surface 94 and gripper face 104. The edge of sheet 22 abuts against this vertically projecting surface 106, thereby locating it circumferentially with respect to the impression cylinder, as it is fed into the gripper finger 98. The sheets are fed between runners (not shown) to properly orient them in the axial direction with respect to the first impression cylinder 18. As the cam arm 110 follows around cam 108, it is actuated to close the gripper fingers 98 against flat surface 94. In the preferred embodiment, gripper fingers 98 are biased or spring-loaded toward a closed position. Cam arm 110 moves the gripper finger against the springs 100 when it contacts cam arm 108, and releases the gripper fingers to close when cam arm 110 moves past cam 108. Thus, the gripper fingers 98 are permitted to clamp down on the sheet 22. Sheet 22 is drawn by the gripper bar, which rotates with the impression cylinder 18, into printing or rolling engagement between the impression cylinder cylindrical surface 84 and the corresponding blanket cylinder 16.

Registration projections 90 are rigidly attached to the gripper bar 48. Each projection 90 is received into the registration pocket 88 which is rigidly affixed to the impression cylinder 18. This construction repeatably holds the gripper bar 48 in proper alignment or proper registration of sheet 22 with respect to the impression cylinder 18. The flat surface 94 of the beam 92 is positioned slightly below, but substantially parallel to the cylindrical surface 84 of the impression cylinder 18. The parallel alignment holds the sheet 22 straight on cylinder 18 and avoids variations in circumferential orientation from one end of the cylinder to the other. Pocket 88 further cooperates with the registration projection 90 to hold the gripper bar in axial alignment (i.e., maintaining the gripper bar in proper side-to-side alignment with the impression cylinder). The gripper bar 48 is also held in circumferential registration by registration wheel 90 and registration pocket 88. The registration of each gripper bar is preferably synchronized with each subsequent impression cylinder so that the image or the matrix of color dots applied at each impression cylinder is coordinated with each other image or color applied at each other impression cylinder.

To facilitate rapid alignment of the projection wheel 90 for insertion into pocket 88, a pre-alignment V-shaped rail 91 is affixed to the printer at a slight angle with respect to the path of the projection wheel 90 and positioned so that the V-shaped projection wheel 90 is smoothly moved along the rail 91 into proper prealignment with the registration pocket 88 so that proper engagement of the projection wheel within the projection pocket 88 is facilitated at each set of printing cylinders.

Figure 5:
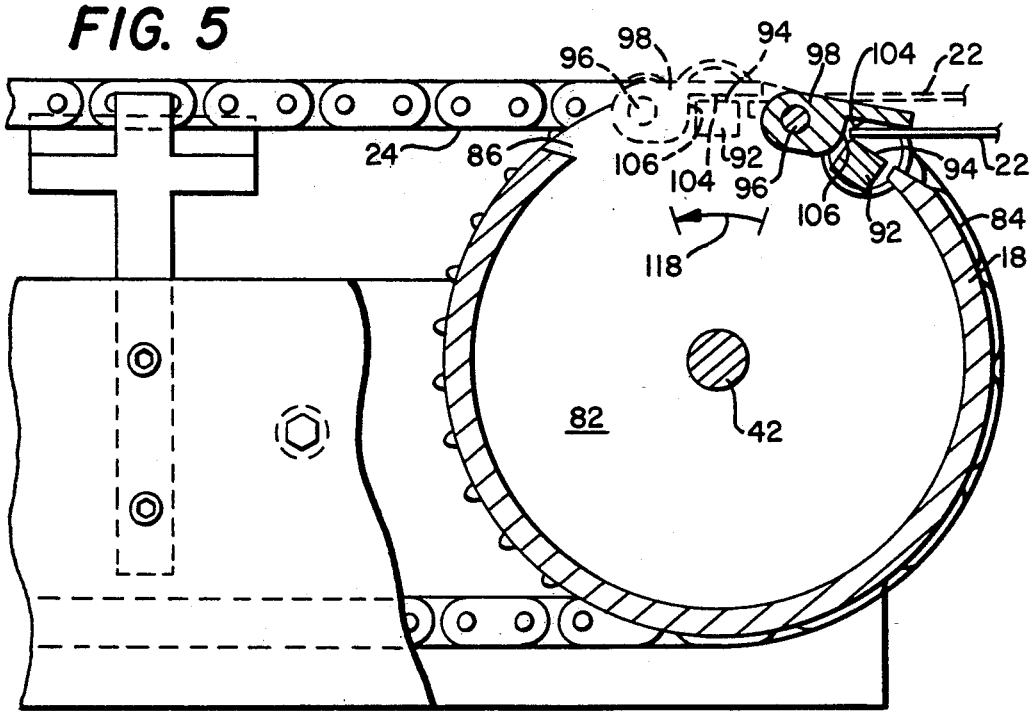
FIG. 5 is a partial detail side section view of the first impression cylinder taken along line 5—5 of FIG. 4, showing gripper orientation.
Figure 6:
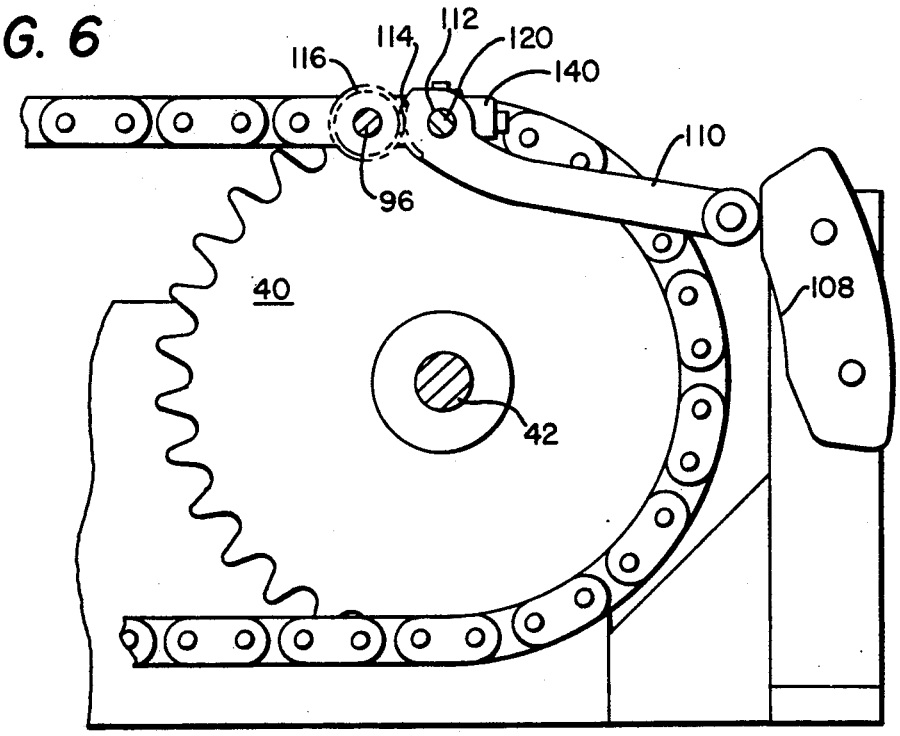
FIG. 6 is a partial section view taken along line 6—6 of FIG. 4, showing details of the cam associated with the movable gripper of the invention.

The operation and construction of the gripper finger may be further understood with reference to FIGS. 5 and 6, in which FIG. 5 is a cross-sectional view of the gripper bar conveyor assembly of FIG. 4, taken along section line 5—5 and FIG. 6 is a section view taken along section line 6—6. In FIG. 5, an individual gripper finger 98 is shown in an open position in solid lines and in a closed position in phantom lines. The gripper finger 98 has a horizontal or gripping face 104 and a vertical surface 106. A cam 108 which is fastened to the frame 50 actuates a cam arm 110 (shown in FIG. 6 in a corresponding closed position in solid lines and a corresponding open position in phantom lines). In this manner, the gripper bar 48, which is fastened to the conveyor band 24 at either end, is carried around impression cylinder 18. The cam arm 110 is attached to gripper bar 48 and becomes engaged against cam 108, thereby partially rotating cam arm 110 about a pivot 112 so that gear teeth 114 formed at the pivot end of cam arm 110 mesh with gear teeth 116 at the end of shaft 96 to partially rotate the shaft 96. The individual gripper fingers 98 are pivoted about shaft 96 to form an opening between horizontal surface 104 and flat surface 94. In a subsequent position in the rotation of impression cylinder 18, gripper finger 98, as shown in phantom lines, is moved an angular distance 118 which in turn moves the cam arm 110 out of engagement with cam 108. Springs 100 are thus permitted to push the gripper fingers 98 downward against paper 22 to hold it securely between flat surface 94 and horizontal gripper face 104. As can be seen in FIG. 5, the entire gripper bar 48 fits within opening 86 into the hollow central portion 82, so that it is below the path of travel of the circumferential surface 84 of the impression cylinder. The gripper fingers 98 extend beyond the surface only when opened, so that they pass below blanket cylinder 16 when they are in a closed, sheet gripping position.

Figure 7:
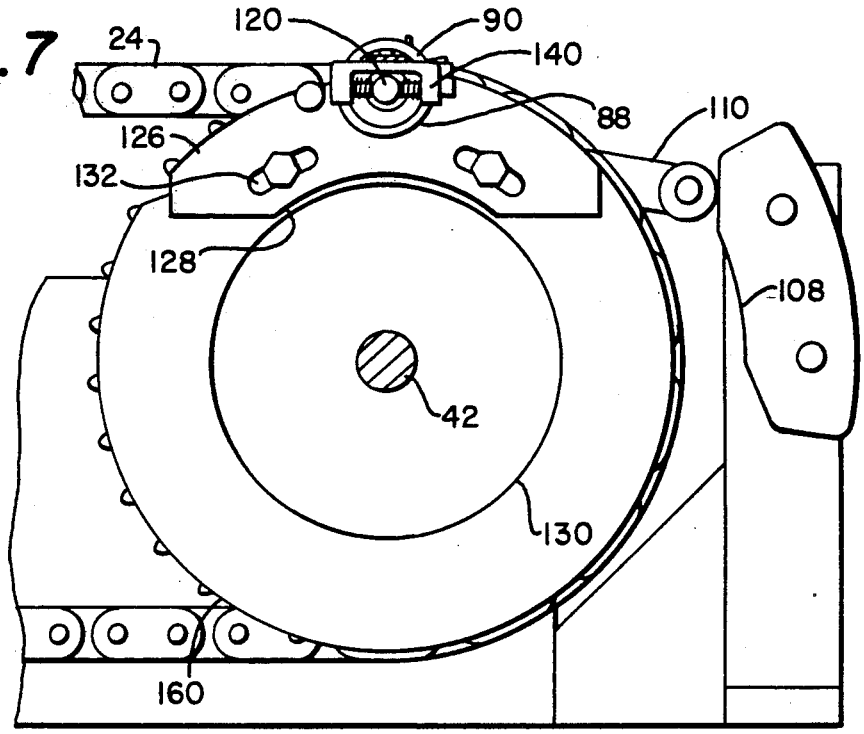
FIG. 7 is a partial section view taken along line 7—7 of FIG. 4 showing details of the assembly of a preferred embodiment of a registration pocket and flexible bracket for holding the gripper bar to the conveyor band.
Figure 8:
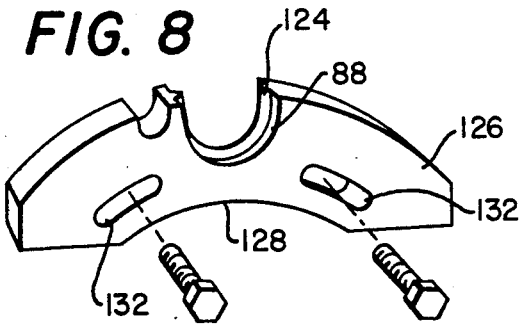
FIG. 8 is a detail perspective view of a preferred embodiment of a registration pocket which is adjustably affixable to the impression cylinder.
Figure 9:
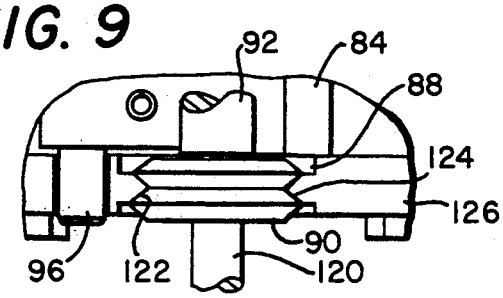
FIG. 9 is a top plan view of a preferred embodiment of a registration projection wheel engaged within a registration pocket according to the present invention.

In the preferred embodiment shown, as more clearly depicted with reference to FIGS. 7, 8, and 9, the construction and attachment of registration pocket 88 and registration projection 90 may be more fully appreciated. FIG. 7 is a partial section view along section line 7—7 of FIG. 4. FIG. 8 is a perspective view of a registration plate into which registration pocket 88 is formed. FIG. 9 is a partial cut-away top view of a registration wheel 90 engaged in registration pocket 88. Thus, in the preferred embodiment shown, projection 90 comprises a wheel 90 having a circular peripheral surface 122, which has a uniform V-shaped cross-sectional profile. The registration pocket 88 has a corresponding reverse image V-shaped rim 124. The pocket 88 is preferably formed in an adjustably attachable plate 126 which has a curved surface 128 corresponding in size to a circular boss 130 formed at both ends of the impression cylinders. The curved surface 128 of plate 126 is sized to fit against circular boss 130 so that the radial position of the gripper bar 48 is properly and accurately spaced in a radial direction for each identically machined circular boss 130 on each end of each impression cylinder. When the projection wheel 90 is fully inserted into registration pocket 88 so that V surface 122 of wheel 90 is fully seated against V surface 124 of pocket 88, the nature of complementary V-shaped surfaces 122 and 124 are such that the projection wheel 90 fits into the pocket 88 in axial alignment. Wheel 90 is affixed to attachment shaft 120 for rotation, but is not movable with respect to shaft 120 in an axial direction. Thus, movement of wheel 90 as "V" 122 engages rim 124 moves the entire gripper bar 48 into proper axial alignment. Slotted holes 132 are preferably milled in an arc so that the plate 126 can be positioned circumferentially about the impression cylinder without changing the radial position of the pocket 88. When the plate is properly positioned, it is rigidly affixed using, for example, threaded fasteners 134 to hold the plate fixed relative to the impression cylinder. Wheel 90 is sized to roll into the pocket 88 and is held in the proper circumferential position. Using identically sized and shaped wheels for each gripper bar and identically sized pockets for each impression cylinder provides registration which is repeatable each time the gripper bar is moved into position for engagement of projection wheel 90 into pocket 88.

Figure 10:
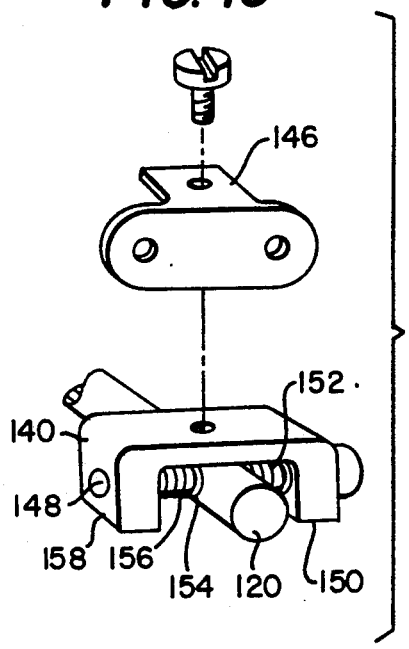
FIG. 10 is a perspective assembly view showing details of the flexible attachment bracket according to the present invention.

As the conveyor band 24 may stretch or wear slightly in a linear direction during operation, it is important that registration be accomplished independent of the position of the gripper bar with respect to its attachment to the conveyor band or chain. FIGS. 7 and 10 depict a unique flexible bracket 140 which advantageously interconnects the conveyor band 24 with attachment shaft 120 to securely attach the gripper bar to the conveyor band, while permitting a small amount of movement in a linear direction with respect to the conveyor band or a circumferential direction with respect to the impression cylinder. In the case of a conveyor chain, as shown in FIG. 10, the bracket 140 is a "U"-shaped bracket attached to the chain using a side projecting tab 146. Links with tabs are standardly available for roller chain. Other means for attaching a flexible bracket 140 to other types of conveyor bands may also be adaptable, depending on the band material used. Bracket 140 may be constructed with a pin 148 inserted through one end 150 of the U bracket. Pin 148 extends through a resilient spring 152, through an orifice 154 in attachment shaft 120, through a second resilient spring 156, and into an opposed end 158 of U-shaped bracket 140. Attachment shaft 120 is smaller than the space between ends 150 and 158 so that shaft 120 can move slidingly along pin 148 in either direction by compressing springs 152 or 156. Thus, small amounts of misalignment between the conveyor band and the proper registration position as defined by pocket 88 and registration projection wheel 90 will be automatically accommodated as projection wheel 90 moves into pocket 88 and as V-shaped surface 122 seats against V-shaped rim 124.

Thus, when the first impression cylinder 18 is rotated, it engages a gripper bar at the bottom junction 160 between the conveyor band 24 and the impression cylinder 18. The projection wheels 90*a* and 90*b* properly locate the gripper bar 48 at both ends of the cylinder 18. The gripper bar 48 is rotated circumferentially around the impression cylinder 18 until cam arm 110 engages cam surface 108 to open the gripper fingers 98. When the gripper fingers 98 are opened, a sheet 22 to be printed is fed horizontally against the vertical surface 106 of the gripper finger 98. As the cam arm 110 moves out of engagement with cam surface 108, the gripper fingers securely clamp onto the sheet 22. As the impression cylinder 18 continues to rotate, sheet 22 is drawn by the gripper fingers 98 into rolling engagement between impression cylinder 18 and the blanket cylinder 16 to thereby initiate with proper registration of sheet 22 as it is printed. After printing is initiated, the pressure between the blanket cylinder 16 and the impression cylinder 18 continues to hold sheet 22 in non-slip engagement as it is printed. Those skilled in the art will understand that substantial pressure is imparted between the impression cylinder and the blanket cylinder during rotary printing. The magnitude of the pressure varies from press to press and from printing job to printing job. However, high pressures are not uncommon, depending upon the size of the impression cylinders involved.

As the impression cylinder 18 continues to rotate, conveyor band 24 attachment moves horizontally toward the next set of printing cylinders, so that bracket 140 effectively "lifts" the gripper bar 48 out of the impression cylinder, thereby disengaging registration projecting wheel 90 from registration pocket 88. The conveyor band moves the gripper bar to the next impression cylinder which is synchronized, through spacing and proper indexing of the conveyor band, for engagement of protecting registration wheels 90 into registration with identical registration pockets 88 positioned on subsequent impression cylinder 32. Registered alignment is accomplished during a portion of the rotation sufficient to initiate printing and the gripper bar is moved in like fashion to each subsequent impression cylinder 54 and 58. It being understood that while four or fewer impression cylinders have been shown in the embodiments depicted, greater or fewer numbers of impression cylinders may be used with the same inventive principles. Once again, the second and subsequent sets of printing cylinders need not be provided with a cam 108 for operating the gripper fingers 98 because once the gripper bar grips a sheet 22, it need not be released until the printing is completed. The paper is thus positioned in proper registration with respect to each impression cylinder by means of the accurate registration of the wheel 90 into pockets 88. When the printing is completed, the gripper bar 48 is moved to return to a skeleton cylinder 38, which comprises return drive wheels 38 for redirecting the continuous conveyor band 24 under impression cylinders and back to first impression cylinder 18 to initiate the cycle again. The spacing between each cylinder is the same on the top and the bottom so that the projection wheels 90 may be reinserted into pockets 88 without effect as they pass underneath each impression cylinder.

As shown in FIG. 2, the sheet 22 may be advantageously released directly from gripper bar 48 to delivery chain 62. Arm 110 engages release cam 61 as delivery gripper 62 is simultaneously activated to grab onto the printed sheet 22. Channels 134 formed in gripper bar 48, accommodate delivery grippers 62 so that sheet 22 continues horizontally out of the press without bending or otherwise changing directions. This avoids the need to keep the sheet bending when the delivery chain grabs the printed paper. Thus, the present invention avoids tracking or smearing often associated with devices used to assist continuous bending of the sheets to avoid bunching at the delivery chain pickup. The printed sheets are delivered and released into a collection tray 64.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A gripper bar conveyor mechanism for transferring sheets to be printed from one rotating impression cylinder to another in an offset printer of the type having a plurality of sets of impression cylinders and corresponding blanket cylinders for rolling contact with the sheets to be printed therebetween, said gripper bar conveyor mechanism comprising:

a) a transferable gripper bar activatable for releasably securing sheets to be printed in a fixed orientation with respect to said transferable gripper bar;

b) a registration projection affixed to said transferable gripper bar;

c) a registration pocket affixed to each of said impression cylinders for temporarily receiving said registration projection and holding said affixed gripper bar in a desired position with respect to each of said impression cylinders while rolling contact of the sheet to be printed is initiated between each of said impression cylinders and said corresponding blanket cylinders; and d) a conveyor band attached to said gripper bar and operably connected to said rotary offset press for transferring said transferable gripper bar from one impression cylinder to said another impression cylinder so that said registration projection is engaged in said registration pocket at each impression cylinder during a portion of the impression cylinder rotation sufficient to initialize rolling contact of said sheet to be printed in proper registration between each of said impression cylinders and said corresponding blanket cylinders.

2. A gripper bar conveyor mechanism as in claim 1 wherein:

a) said impression cylinders have axially opposed ends;

b) said gripper bar has axially opposed ends, each extending in an axial direction to said ends of said impression cylinders;

c) said registration projection comprises two projections, one at each axially opposed end of said gripper bar; and d) said registration pocket comprises two registration pockets, one at each end of said impression cylinder.

3. A gripper bar conveyor mechanism as in claim 1 wherein:

a) said registration projection comprises a registration wheel having a circular periphery with a predetermined diameter and a uniform cross-sectional profile shape therearound; and b) wherein said registration pocket comprises a semicircular shaped pocket corresponding in size to said diameter of said registration wheel and having a cross-sectional shape which is complementary to said peripheral shape of said registration wheel so that said registration wheel fits within said registration pocket aligned in a predetermined radial, axial and circumferential orientation.

4. A gripper bar conveyor mechanism as in claim 3 wherein:

a) said uniform cross-sectional peripheral shape of said wheel edge comprises a "V" shape; and b) said complementary peripheral shape of said semicircular pocket comprises a reverse "V" shape.

5. A gripper bar conveyor mechanism as in claim 4 further comprising pre-alignment V-shaped rails affixed to the printer at a slight angle with respect to the path of the projection wheels attached to said gripper bar so that said V-shaped projection wheel is smoothly moved along said rail into proper pre-alignment with said registration pocket "V" shape so that proper engagement of the projection wheel within the projection pocket is facilitated.

6. A gripper bar conveyor mechanism as in claim 1 further comprising a flexible bracket through which said gripper bar is attached to said conveyor band to provide resilient flexure between said conveyor band and said gripper bar so that a small amount of circumferential misalignment between said gripper bar, as it is attached to said conveyor band and said registration pocket, as it is affixed to said impression cylinder, can be accommodated through flexure at said flexible bracket as said registration projection is received into said registration pocket in proper registration.

7. A gripper bar conveyor mechanism as in claim 1 wherein said conveyor band comprises:

a) a sprocket wheel affixed to each of said impression cylinders for coaxial rotation therewith; and b) a continuous roller link chain extending between and moved with said sprocket wheel affixed to each of said impression cylinders.

8. A gripper bar conveyor mechanism as set forth in claim 1 wherein said conveyor band comprises:

a) a continuous fan belt of the type having evenly spaced teeth therealong; and b) a gear pulley having corresponding teeth for synchronized meshing with said conveyor belt and attached for coaxial rotation with said impression cylinders.

9. A gripper bar conveyor mechanism as in claim 1 wherein said conveyor band comprises a pair of continuous parallel bands indexed to rotate in synchronization with each of said impression cylinders.

10. A gripper bar conveyor mechanism as in claim 9 wherein:

a) said registration projection affixed to said transferable gripper bar comprises at least two wheels, each wheel attached to said transferable gripper bar axially aligned and spaced apart from each other; and b) said registration pocket comprises at least two semi-circular shaped wheel receiving pockets attached to said impression cylinder, each axially aligned with the other parallel to said impression cylinder and each positioned for receiving one of said at least two projection wheels therein in precise axial, radial, and circumferential registration.

11. A gripper bar conveyor mechanism as in claim 9 wherein:

a) said impression cylinders each have two co-axially spaced apart ends;

b) said gripper bar has two opposed ends which extend beyond said impression cylinder ends;

c) said at least two wheel-receiving pockets are attached to said ends of said impression cylinders; and d) one of said at least two projection wheels is attached at each opposed end of said gripper bar for insertion into said semi-circular shaped wheel receiving pockets.

12. A gripper bar conveyor mechanism as in claim 11 wherein said:

a) registration pockets further comprise a plate having a semi-circular shaped pocket formed therein;

b) a circular disk-shaped boss formed coaxial with a rotation axis of said impression cylinder;

c) an interior radial surface on said plate for contacting said circular disk-shaped boss on said impression cylinder, thereby locating the registration pocket at a proper radial distance from said rotation axis of the impression cylinder; and d) arc-shaped grooves through which threaded fasteners attach said plate to the end of said impression cylinder, which arc-shaped grooves and fasteners permit circumferential adjustment of said plate for affixing said plate with said pockets in proper circumferential location with respect to said impression cylinder.

13. A gripper bar conveyor mechanism as in claim 12 further comprising at least two flexible brackets, each flexible bracket attached to said transferable gripper bar spaced apart from each other bracket for interconnecting said gripper bar to said parallel conveyor bands, which flexible brackets permit said transferable gripper bar to move relative to said conveyor bands as said registration projection is received in said registration pocket, thereby permitting precise registration with said impression cylinder despite minor misalignments between said conveyor band and said impression cylinder.

14. A gripper bar conveyor mechanism as in claim 1 wherein said transferable gripper bar comprises:

a) multiple gripper fingers pivotably fastened to a bar for pivoting between an open position and a closed position;

b) a cam-actuated rod for moving said gripper fingers between said open position and said closed position; and c) a first cam device for actuating said cam-actuated rod to open said multiple gripper fingers to receive a sheet to be printed and for actuating said cam-actuated rod to close said multiple gripper fingers to hold said sheet in a fixed orientation with respect to said transferable gripper bar.

15. A gripper bar conveyor mechanism as in claim 14 wherein said first cam device for actuating said rod to open said gripper fingers further comprises:

a) a spur gear affixed to said cam-actuated rod;

b) a cam arm having pivotally attached adjacent said spur gear and having teeth thereon intermeshing with said spur gear;

c) a cam surface against which said cam arm is actuated as said gripper bar is carried about said first impression cylinder, thereby raising said gripper fingers against said bias to open them for receiving a sheet to be printed; and d) a termination end of said cam surface past which said cam arm is released to allow said gripper fingers to securely clamp onto said sheet to be printed.

16. A gripper bar conveyor mechanism as in claim 1 further comprising a direct drive gear train for powering the impression cylinders.

17. A gripper bar conveyor mechanism as in claim 16 wherein said direct drive gear train further comprises:

a) a bevel gear attached to a drive shaft; and b) a corresponding bevel gear attached to said impression cylinder for engagement and power transmission from said drive shaft.

18. A gripper and conveyor mechanism for moving sheets to be printed in a rotary offset printer from one set of printing cylinders to another set until printing is completed at each set of cylinders, said gripper and conveyor mechanism comprising:

a) a movable gripper bar activatable for securing a sheet to be printed in a single fixed orientation with respect to said movable gripper bar and for holding said sheet until printing is completed at each set of printing cylinders;

b) a registration projection rigidly connected to said movable gripper bar;

c) a registration pocket affixed to one cylinder of each set of printing cylinders for repeatably receiving said registration projection and holding said movable gripper bar in proper registration while printing of said held sheet is initiated at each set of cylinders; and d) a conveyor operably attached to said gripper and synchronized with said printing cylinders for moving said gripper bar from one of said sets of cylinders to the next so that said registration projection is repeatably received in proper registration in said registration pocket at each of said sets of printing cylinders.

* * * * *